US005842801A

United States Patent [19]

Myung

[11] Patent Number: 5,842,801

[45] Date of Patent: Dec. 1, 1998

[54] DEVICE AND METHOD FOR ADJUSTING PRINTING POSITION OF A PRINTER

[75] Inventor: Ho-Suck Myung, Ahnyang, Rep. of Korea

[73] Assignee: SamSung Electronics Co., Ltd., Suwon, Rep. of Korea

[21] Appl. No.: 926,235

[22] Filed: Sep. 10, 1997

[30] Foreign Application Priority Data

Sep. 10, 1996 [KR] Rep. of Korea ..... 1996 39127

[51] Int. Cl.[6] ..... B41J 29/18

[52] U.S. Cl. ..... 400/708; 400/56; 400/596; 271/2; 347/16

[58] Field of Search ..... 400/708, 708.1, 400/56, 596, 600.2, 582, 707.1, 703; 347/16, 55, 57; 271/2

[56] References Cited

U.S. PATENT DOCUMENTS

| | | | |
|---|---|---|---|
| 4,610,445 | 9/1986 | Schneider et al. | 271/160 |
| 4,728,963 | 3/1988 | Rasmussen et al. | 271/209 |
| 4,843,338 | 6/1989 | Rasmussen et al. | 346/140 R |
| 4,944,136 | 7/1990 | Gough | 53/493 |
| 5,080,509 | 1/1992 | Stone | 400/23 |
| 5,399,039 | 3/1995 | Giles et al. | 400/636 |
| 5,481,336 | 1/1996 | Tachibana et al. | 355/207 |
| 5,564,847 | 10/1996 | Patrick et al. | 400/642 |
| 5,572,310 | 11/1996 | Hoberoxk et al. | 399/370 |
| 5,603,493 | 2/1997 | Kelly | 271/188 |

*Primary Examiner*—Edgar S. Burr
*Assistant Examiner*—Dave A. Ghatt
*Attorney, Agent, or Firm*—Robert E. Bushnell, Esq.

[57] ABSTRACT

A method and a device for adjusting the printing position of a printer head. When a recordable medium having a greater thickness than that of a standard cut sheet of letter size paper is inserted in an electrophotographic apparatus, it is often necessary to increase the distance between the top recordable medium in the paper supply tray and the paper input port in the electrophotographic apparatus to allow a greater number of thick sheets of recordable medium to be loaded. One method of increasing the distance is to rotate a guide panel into a position that abuts the electrophotographic apparatus and increases the distance between the paper supply tray and the paper receiving port. Unfortunately, this causes the printer head to require adjustment, as the horizontal positioning of the printable medium fed into the printer has changed. This inventive method and device uses a sensor to determine when the guide panel has been rotated and automatically adjusts the printer head's position.

15 Claims, 6 Drawing Sheets

DEVICE AND METHOD FOR ADJUSTING PRINTING POSITION OF A PRINTER

CLAIM OF PRIORITY

This application makes reference to, incorporates the same herein, and claims all benefits accruing under 35 U.S.C. §119 from an application entitled *DEVICE AND METHOD FOR ADJUSTING PRINTING POSITION OF A PRINTER* earlier filed in the Korean Industrial Property Office on 10 Sep. 1996, and there duly assigned Serial No. 96-39127.

BACKGROUND OF THE INVENTION

1. Field of the Invention

The present invention relates to a paper feed device for a printer. More specifically, the present invention relates to a device and a method for automatically adjusting printing position to accommodate thick recording papers.

2. Description of the Prior Art

In general, a printer sequentially conveys, page by page, a plurality of printable media such as recording papers from a paper feed tray to a printer head with a pick up roller. The sequentially-conveyed recording papers are separated, page by page, with a finger or separator.

Exemplars of conventional practice in the art include U.S. Pat. No. 4,610,445 for *Integrated Printer and Tray Paper Feeding Apparatus* issued to Schneider et al., that shows in FIGS. 11 and 12 and columns 14 and 15, that the device includes an envelope feeding assembly. The device also includes sensors 62 for detecting when a sheet of paper or envelope has been picked up by the plate. The sensor also serves to provide a reference point used in positioning the print wheel for proper print positioning relative to the paper.

U.S. Pat. No. 4,843,338 for *Ink-Set Printhead-to-Paper Referencing System* issued to Rasmussen et al., referring to FIG. 4 and column 4, lines 45–68, the device includes pinch rollers 20 which maintain thick paper 12 at an angle to the printer head which provides sufficient clearance to avoid smearing of the ink on the medium.

I have found that one problem with this conventional practice in the art for handling diversely-sized papers is that the difference between the relative distance between the recording paper and the printer head, and an envelope guide-fed recording paper and the printer head. Typically, the envelope-guide fed paper presents a surface that is about six millimeters closer to the printer head than general paper fed from a tray. As a result, a user must instruct a printer driver to adjust the print data accordingly.

SUMMARY OF THE INVENTION

It is an object of the present invention to provide an improved device and process for forming images upon printable media.

It is another object to provide a device and a method for converting printing position of a printer to accommodate thick recording papers by opening a guide panel on the printer, thus relieving a user from having to instruct a printer driver to make the adjustment.

In order to achieve these and other objects, the present invention includes ribs formed on the rotation axis couplers of a guide panel and a sensor positioned in opposition to the envelope guide that senses when the ribs of the guide panel are moved, due to opening or closing of the guide panel.

The present invention also may be accomplished with a sensor sensing opening of the guide panel; a controller for adjusting and outputting the data at a given distance from the recording paper when opening of the guide panel is sensed by the sensor; and a printing unit for printing data outputted from the controller.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1A:
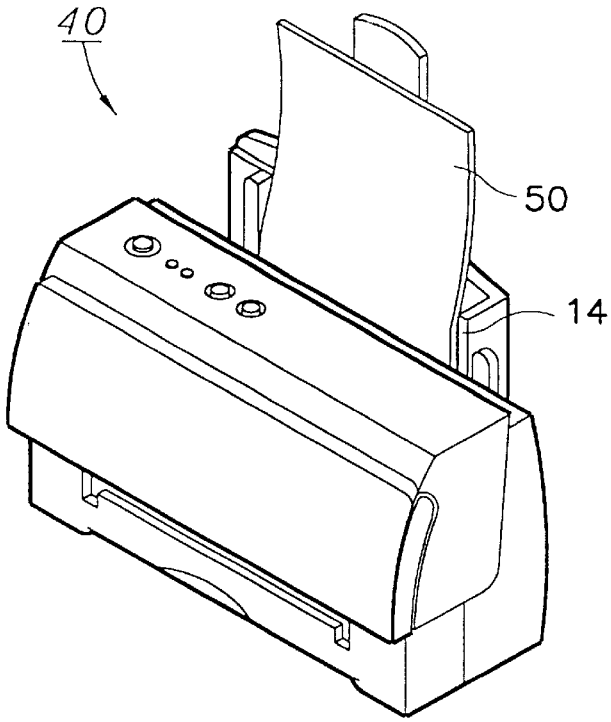
FIG. 1A is a top right front perspective view of an image forming apparatus with recording papers loaded into an unopened guide panel.
Figure 1B:
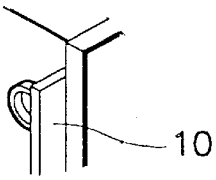
FIG. 1B is an enlarged top right front perspective view of a portion of the unopened guide panel of FIG. 1A encircled in FIG. 2 by the line 1B—1B.
Figure 2:
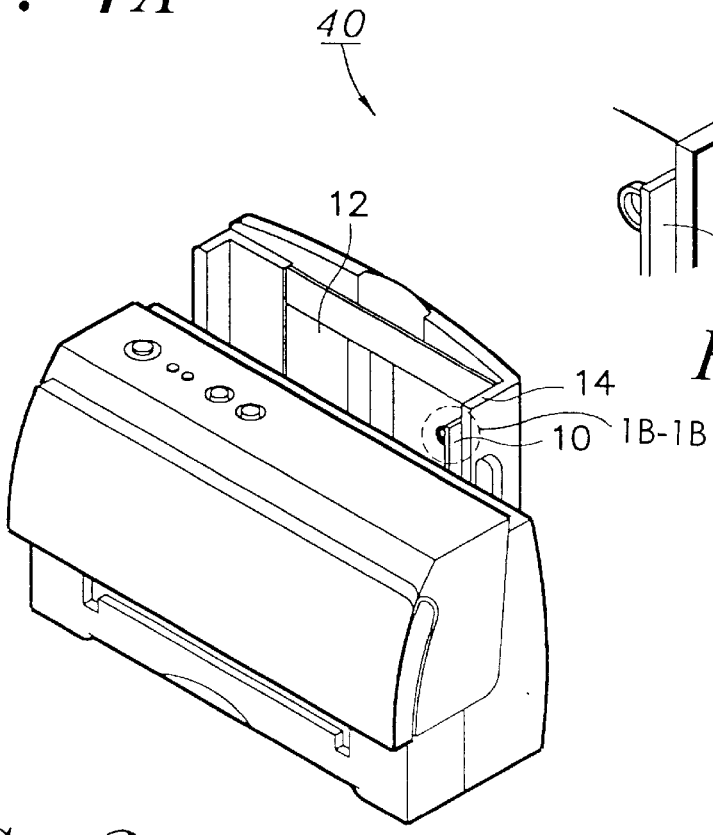
FIG. 2 is a top right front perspective view of the printer of FIG. 1A with the guide panel opened.
Figure 3:
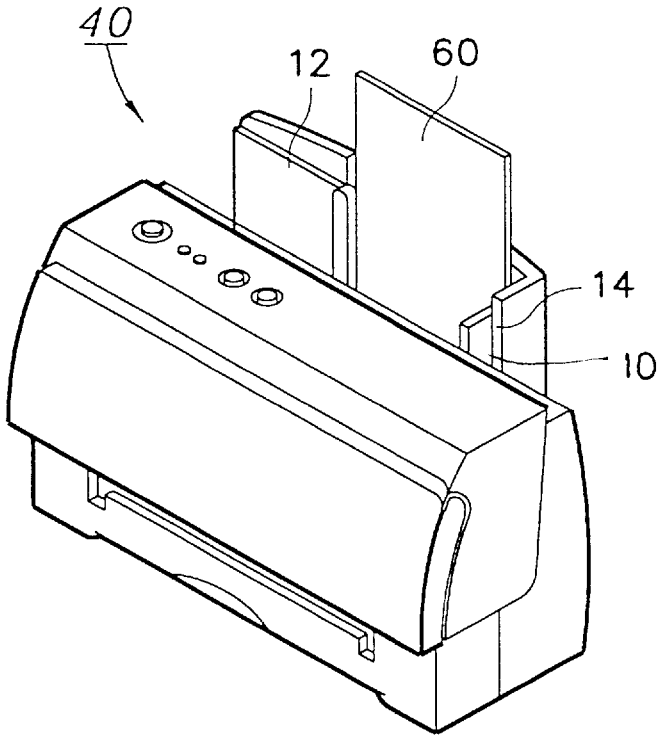
FIG. 3 is a top right front perspective view of general recording papers loaded into an opened envelope guide of a typical printer.

Turning now to the drawings, as shown in FIGS. 1A, and 1B, the general recording papers 50 may be introduced into a printer 40 through paper or envelope guide 14. In general, a printer 40 sequentially conveys, page by page, a plurality of recording papers 50 from a paper feed tray to a printer head with a pick up roller. The sequentially-conveyed recording papers are separated, page by page, with a finger or separator. When thicker recording papers 60, such as envelopes, are needed to be printed, as shown in FIGS. 2 and 3, guide panel 10 is opened and the size of the recordable medium is recognized. Guide panel 10 is open owing to the finger for separating, page by page, a plurality of the recording papers in an automatic paper feed device. Ordinarily, with the general recording papers, the finger plays a role of sequentially conveying the recording papers page by page. However, the finger can not effectively perform its function with respect to thick recording papers. It should be understood that the word "thick" as used in both the specifications and the claims should be interpreted as meaning "having a thickness greater then that of standard letter sized paper." Accordingly, when conveying thick recording papers 60, the finger is not operated, thus necessitating opening the envelope guide 10.

Figure 4:
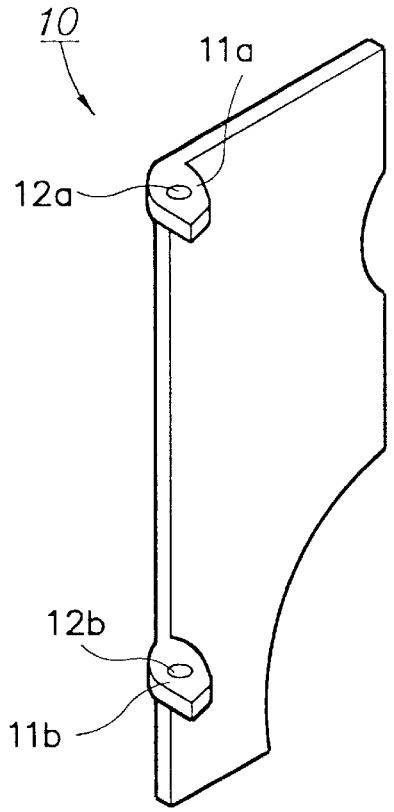
FIG. 4 is a partial top left rear perspective view of a typical envelope guide.

Referring to FIG. 4, a typical guide panel is shown including rotation axis couplers 11*a* and 11*b*, having insertion holes 12*a* and 12*b*, extending from upper and lower portions of the guide panel 10. When thick recording papers are used, the envelope guide may be rotated about a hinge proximate to the paper feed. A problem with this convention for handling diversely-sized papers is the difference between the relative distance between a general recording paper and the printer head, and an envelope guide-fed recording paper and the printer head. Typically, the envelope-guide fed paper presents a medium guiding surface six millimeters close to the printer head than general paper fed from a tray. As a result, a user must manually instruct a printer driver to adjust the print data accordingly.

Figure 5:
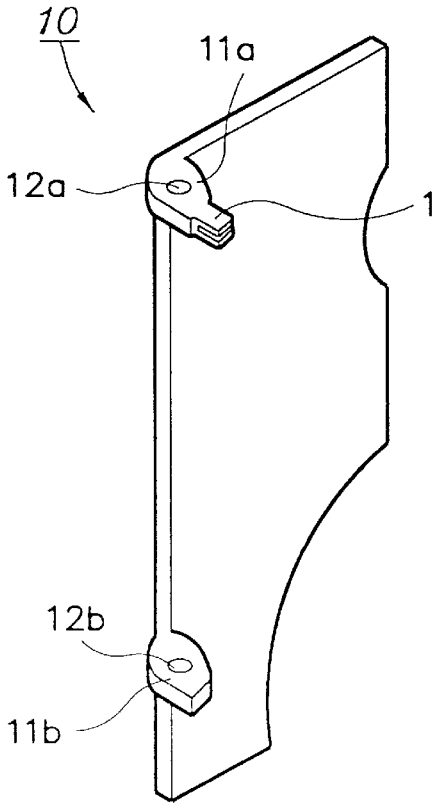
FIG. 5 is a partial top left rear perspective view of an envelope guide constructed according to the principles of the present invention.

FIG. 5 is a perspective view showing the guide panel according to an embodiment of the present invention. Guide panel 10 has a rib 1 extending from one of the rotation axis couplers 11*a* and 11 *b*. The rib 1, preferably, is at a right angle to the body of the guide 10.

Figure 6A:
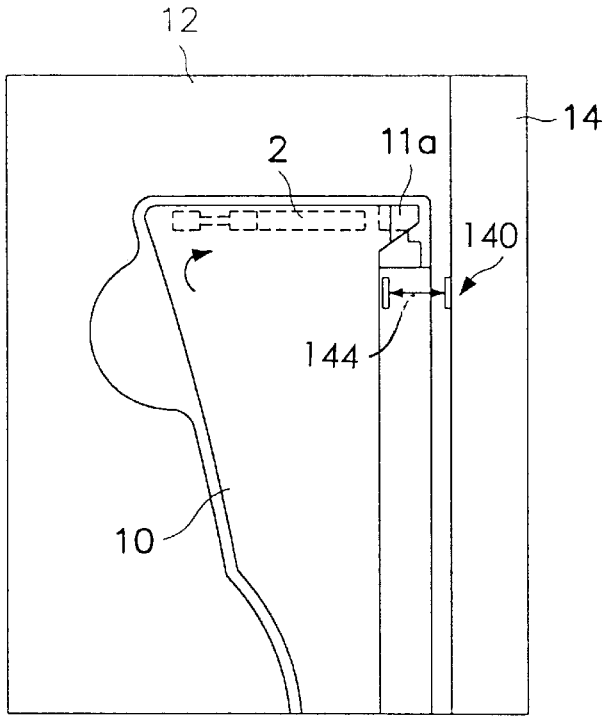
FIGS. 6A and 6B are right side elevational views, partially in cross section, of the envelope guide in an open position and a closed position, respectively.
Figure 6B:
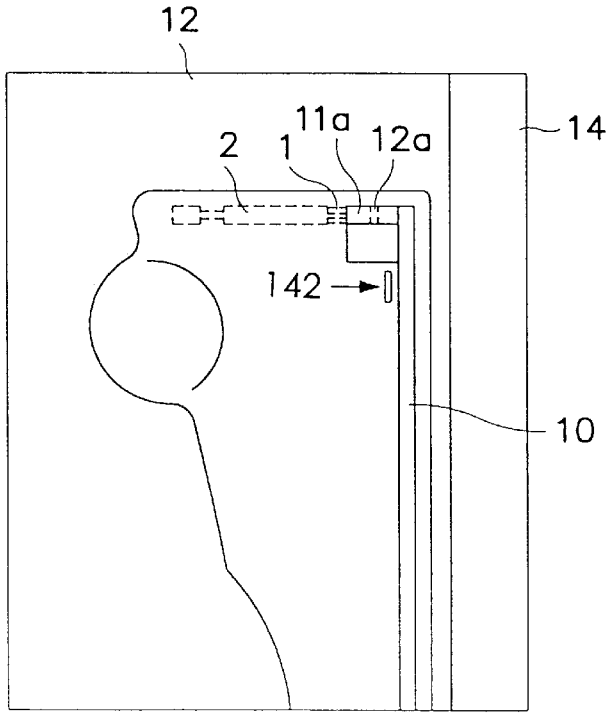

Referring to FIGS. 6A and 6B, a sensor 2 is installed in opposition to the rib 1. The sensor 2 is activated when contacted by or separated from the rib 1, in accordance with opening/closing of the guide panel 10.

Referring to FIG. 6A, when general recording papers are fed into the printer, the paper or envelope guide 14 presents a first medium guiding panel surface 140 for maintaining the papers. When thick recording papers are to be used, the guide panel is opened, presenting a second medium guiding surface 142 for maintaining the papers. A distance 144 exists between the first medium guiding position of the second medium guiding surface 140 and the surface 142.

When opened, the present envelope guide 10 rotates a sensor sensing rib 1 into contact with sensor 2, activating it. When printing of the envelope is completed, the guide panel is closed for printing general recording papers, separating the rib 1 from the sensor 2, deactivating it. The sensor 2 is switched on or off depending on the opened or closed status of the guide panel 10.

Figure 7:
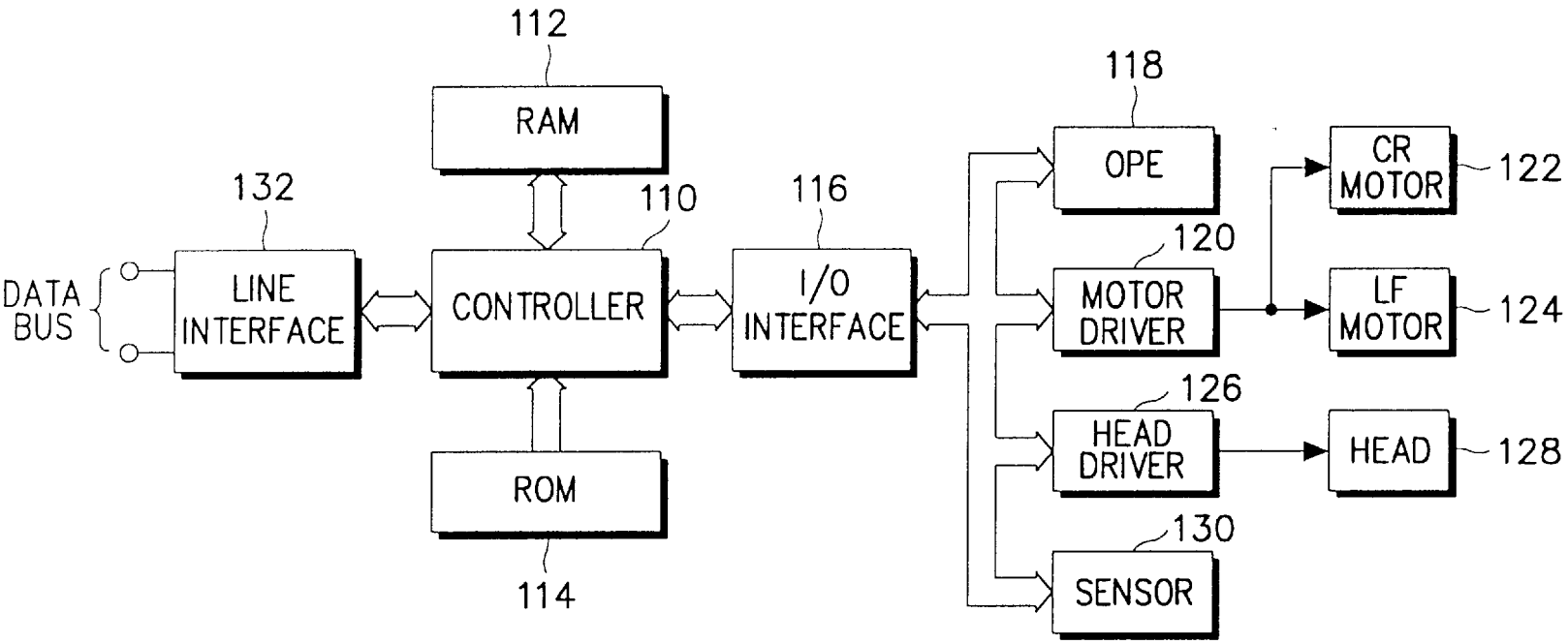
FIG. 7 is a block diagram of a circuit for converting printing position of printer in the practice of the present invention.

FIG. 7 is a block diagram of a device for adjusting printing position of a printer head according to the present invention. A controller 110 controls the printer according to control program stored in a read-only memory 114 (ROM), the ROM 114 stores the control program and initial data and a random access memory 112 (RAM) temporarily stores data generated during operation of the controller 110.

An interface 116 interfaces data transferred between the controller 110 and an input/output unit, such as an operational panel equipment (OPE) 118, a motor driver 120, and a head driver 126. The OPE 118 includes a plurality of keys for inputting various commands. The interface 116 transmits key data to the controller 110 and has a display for displaying the current state of the printer. The motor driver 120 drives a carriage motor 122 (CR motor) and a line feed (LF) motor 124 under control of the controller 110. The CR motor 122 conveys the head cartridge installed with a printer head 128. The LF motor 124 conveys recording media. The head driver 126 drives the head 128 under the control of the controller 110.

Typically, an image is recorded on the recording media by injecting ink through nozzles, having release holes, driven by the head driver 126.

A sensor 130 senses opening of the guide panel that guides thick recording papers, not general recording papers, and provides the sensed results to the controller 110. A line interface 132 interfaces the data transmitted between an external device, for instance, a computer and the ink jet printer.

Figure 8:
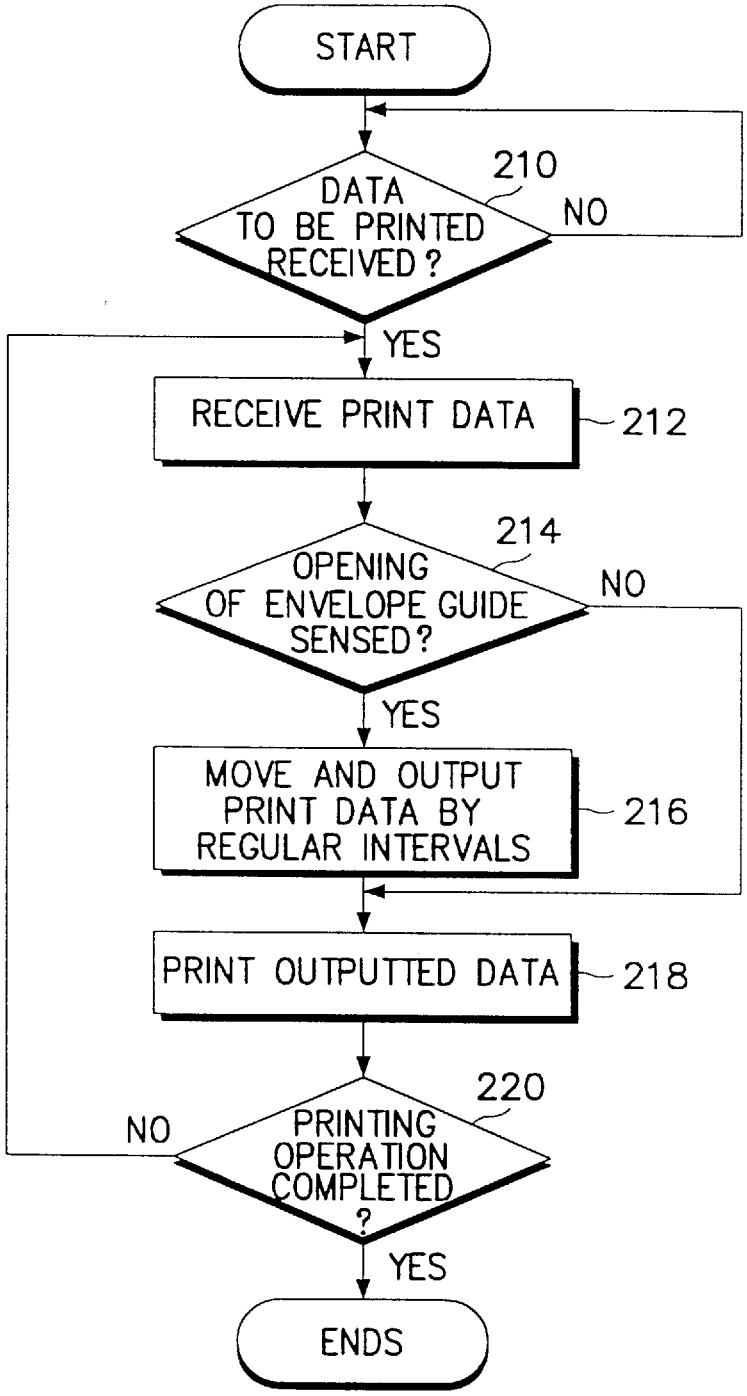
FIG. 8 is a flow chart of one method for converting printing position of printer in the practice of the present invention.

Referring to FIG. 8, method of adjusting the printing position of the data according to the thickness of the target recording papers, includes the steps of: sensing the opening of the guide panel responsive to transmission of print data to be printed; and moving and outputting the print data when the opening of the guide panel is sensed. The controller 110 senses, in step 210, whether data to be printed through the line interface 132 is received. If not received, the controller 110 returns to step 210. If data to be printed was received, the controller 110 receives the transmission of the data to be printed, in step 212.

The controller 110 senses, in step 214, whether or not the guide panel is open, via a sensor. If the guide panel is open, the controller 110 proceeds to step 216, moving and outputting the data to be printed.

In step 218, the controller 110 directs the motor driver 120 and the head driver 126 to print the data provided through the interface 116. The head driver 126 controls the head 128 so as to move and print the data under the control of the controller 110. If the guide panel was not open, the controller 110 proceeds to the above step 218, printing the data without adjustment, received through the line interface 132.

The controller 110 senses in step 220 whether or not printing operation is completed. If not completed, the controller 110 returns to step 212, continuously printing the received data. If completed, the controller 110 ends its function.

It should be understood that the present invention is not limited to the particular embodiments disclosed herein, but encompasses all embodiments within the scope of the appended claims.

What is claimed is:

1. A device for adjusting the printing position of a printer having an envelope guide with a guide panel, the device comprising:

a chassis enclosing a memory and a controller of a printer having a printer head;

a sensor mounted on said chassis and responding to an open position of the guide panel and generating a signal corresponding to the detection of said open position;

said controller of the printer responding to said signal and adjusting a plurality of print data stored in said memory of the printer, and adjusting the formation of a plurality of images represented by said print data upon a printable medium by automatically adjusting the position of the printer head to compensate for the alignment of said printable medium while said guide panel is in said open position.

2. The device as recited in claim 1, further comprising said printer head having an adjusted position corresponding to a distance defined between a first medium guiding surface and a second medium guiding surface.

3. The device as recited in claim 2, wherein the second medium guiding surface supports a medium having a thickness greater than that of a standard sheet of letter sized paper.

4. The device as recited in claim 2, wherein the second medium guiding surface supports a thick medium, and the first medium guiding surface supports a thin medium.

5. The device as recited in claim 1, the guide panel including a rib, said sensor being responsive to said rib.

6. The device as recited in claim 5, wherein said rib extends from a rotation axis coupler of the guide panel.

7. A device for adjusting printing position in a printer having an envelope guide, comprising:

a sensor sensing opening of the envelope guide;

a controller responding to said sensing of said opening by generating adjusted data by modifying image data in dependence upon a given dimension; and a printing unit printing adjusted data upon envelopes passing through said envelope guide.

8. The device as claimed in claim 7, wherein said dimension is defined by an interval between a first medium guiding surface and a second medium guiding surface.

9. A method for adjusting printing position of a printer having an envelope guide with a guide panel, comprising the steps of:

sensing an open position of the guide panel;

generating a signal corresponding to the detection of said open position of the guide panel;

receiving said signal in a controller; and adjusting a plurality of print data, stored in a memory of the printer, with the controller, to automatically adjust a printer head position to compensate for the alignment of a printable medium while said guide panel is open.

10. The method as recited in claim 9, wherein the printer head position is adjusted by an amount corresponding to a distance defined between a first medium guiding surface of the envelope guide and a second medium guiding surface formed by said guide panel while said guide panel is in said open position.

11. The method as recited in claim 8, wherein the second medium guiding surface supports a thick medium.

12. The method as recited in claim 9, wherein the adjusted print data correspond to a distance defined between a first medium support of the envelope guide and a second medium support of the envelope guide.

13. The method as recited in claim 12, wherein the second medium support supports a thick medium, and the first medium support supports a medium having a thickness of standard letter sized paper.

14. The method as recited in claim 9, the guide panel including a rib, said sensor being responsive to said rib.

15. The method as recited in claim 14, wherein said rib extends from a rotation axis coupler of the guide panel.

* * * * *